United States Patent [19]

Gregory

[11] Patent Number: 4,711,592

[45] Date of Patent: Dec. 8, 1987

[54] CAPLESS RETRACTABLE MARKING PEN

[76] Inventor: Allen R. Gregory, 3126 Tidewater Dr., Norfolk, Va. 23509

[21] Appl. No.: 871,469

[22] Filed: Jun. 6, 1986

[51] Int. Cl.[4] ..... B43K 9/00

[52] U.S. Cl. ..... 401/107; 401/108

[58] Field of Search ..... 401/107, 108, 67

[56] References Cited

U.S. PATENT DOCUMENTS

| | | | |
|---|---|---|---|
| 2,626,592 | 1/1953 | Hedler | 401/67 |
| 2,874,679 | 2/1959 | Zepelovitch | 401/107 |
| 3,525,573 | 8/1970 | Fend | 401/108 |
| 3,652,172 | 3/1972 | Zepell | 401/107 X |
| 4,218,154 | 8/1980 | Erfer | 401/107 |
| 4,540,300 | 9/1985 | Midorikawa | 401/107 |
| 4,618,280 | 10/1986 | Kageyama | 401/108 X |

FOREIGN PATENT DOCUMENTS

| | | | |
|---|---|---|---|
| 1561814 | 4/1970 | Fed. Rep. of Germany | 401/107 |
| 1561830 | 4/1970 | Fed. Rep. of Germany | 401/107 |
| 8502149 | 5/1985 | PCT Int'l Appl. | 401/108 |

*Primary Examiner*—Steven A. Bratlie

*Attorney, Agent, or Firm*—Norman B. Rainer

[57] ABSTRACT

An improvement is provided for a retractable tip marking pen whereby the tip, in its retracted position, is enclosed in a chamber which prevents drying of the marking fluid. The chamber is provided by an elastomeric sealing member positioned within the outer sheath of the pen adjacent the lower extremity thereof. The sealing member automatically opens when the tip is pushed to its writing position, and closes when the tip is retracted to its stored position.

3 Claims, 4 Drawing Figures

CAPLESS RETRACTABLE MARKING PEN

This invention is the subject of Disclosure Documents 147031 dated 02/10/86; 147469 dated 3/10/86; 148179 dated 3/28/86; and 148373 dated 4/3/86.

BACKGROUND OF THE INVENTION

This invention relates to pens which utilize a fluid ink and whose writing tips are axially positionable with respect to an outer sheath.

Various types of pens using an aqueous or non-aqueous fluid are in widespread use for writing, drawing, painting or marking purposes, and may collectively be referred to as marking pens. Said fluids, which may be inks having soluble dyes, or paints having dispersed pigments, may be generically referred to as marking fluids. Many of such pens are provided with protective caps which prevent evaporation of the fluid and prevent accidental contact of the fluid with the clothing or skin of the user or with other objects. However, the placement and removal of the cap is troublesome, and the cap is frequently misplaced.

Marking pens which avoid the need for a protective cap are well known and generally employ a mechanism whereby the tip of the pen can be retracted into a protective enclosure within an elongated sheath comprising the outer body of the pen. Marking pens of such construction are disclosed for example in U.S. Pat. Nos. 4,218,154; 3,652,172; and 4,540,300. The protective enclosures and associated retracting mechanisms are, however, generally of complex, expensive construction and do not endure long term use.

Accordingly, it is an object of the present invention to provide a retractable capless marking pen having a protective enclosure within the body of the pen that prevents evaporation of marking fluid from the tip of the pen.

It is a further object of this invention to provide a marking pen as in the foregoing object of rugged and durable construction amenable to low cost manufacture.

These objects and other objects and advantages of the invention will be apparent from the following description.

SUMMARY OF THE INVENTION

The present invention is adapted to be embodied in a marking pen comprising:

(a) a sheath having an upper portion and a lower portion terminating in an open front end, (b) a writing member coaxially disposed within said sheath and having a cylindrical front portion of relatively small diameter terminating in a writing tip, and a rear portion of relatively large diameter which serves as confining reservoir for marking fluid, (c) actuating means associated with the upper portion of the sheath for causing movement of the writing member between a forwardly held writing position and a rearwardly held non-writing position, and (d) a coil spring interactive between said sheath and writing member to drive said writing member to its retracted non-writing position.

In association with a marking pen of the aforesaid nature, the present invention is comprised of:

(e) an elastic sealing member positioned within the lower portion of said sheath and comprised of:

(1) an upper portion having a cylindrical bore centered upon the pen axis and whose diameter permits close-fitting penetrative insertion by the front portion of said writing member, and an annular retaining groove communicating with said bore, (2) a lower portion having two or more segments having inner and outer surfaces and adapted to move between a divergent disposition and a converged disposition adjacent said axis wherein the inner surfaces mate to form a chamber whose upper extremity communicates with said bore, and (3) an intermediate portion having recesses which permit said segments to move in hinge-like manner with respect to said upper portion, (f) a pressing shoulder inwardly directed from the lower portion of said sheath and adapted to engage the outer surfaces of said segments and thereby direct the segments to their divergent and converged dispositions, (g) holding means associated with the lower portion of said sheath and adapted to hold said segments in their divergent disposition, and (h) an activating shoulder disposed upon the front portion of said writing member and adapted to fit within said retaining groove, whereby, (i) when said writing member is moved downwardly within said sheath, said activating shoulder forces said sealing member downwardly, causing: (1) said pressing shoulder to act upon the exterior surfaces of the segments to direct the segments to their divergent disposition, (2) said segments to become held in their divergent disposition by said holding means, (3) said activating shoulder to leave said retaining groove, and (4) said writing tip to protrude from the open front end of the sheath.

(j) when said writing member is moved upwardly within said sheath, said activating shoulder reenters said retaining groove, forcing said sealing member upwardly and causing: (1) said pressing shoulder to act upon the exterior surfaces of the segments to direct the segments to their converged disposition, (2) placement of the writing tip within said chamber formed by the mated inner surfaces of the converged segments, and (3) sealing the upper extremity of said chamber with the writing tip disposed therein.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 2:
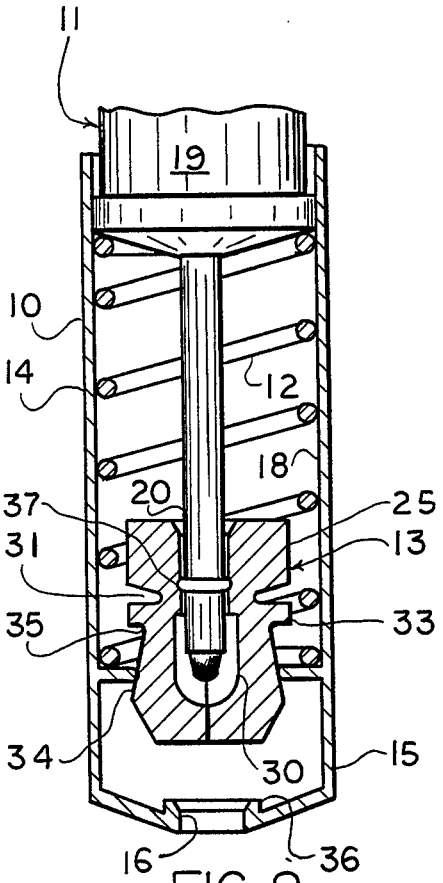
FIG. 2 is a view of the pen of FIG. 1 shown with the writing member in its retracted position.

Referring to the drawings, an embodiment of the marking pen of the present invention is shown comprised of sheath 10 having writing member 11 disposed therein, coil spring 12 disposed between said sheath and writing member, and sealing member 13 disposed within said sheath generally below said writing member.

The sheath, having an elongated hollow configuration, is fabricated of a reasonably rigid material, and serves as the outer body of the pen. The sheath has an upper portion 14 and a lower portion 15 terminating in open front end 16 centered upon the longitudinal axis 17 of the pen. The inner wall 18 of the sheath is of a generally circular cylindrical configuration. In alternative embodiments, the sheath may be of shorter length which does not completely confine the writing member. Such shorter sheaths are particularly useful in wide diameter markers.

The writing member, which is coaxially centered within the sheath, is comprised of an elongated rear portion 19 of relatively large diameter which serves as a confining reservoir for marking fluid, and an elongated cylindrical front portion 20 of relatively small diameter which serves as a marking fluid conduit and terminates in writing tip 21 which may be a ball or felt.

Actuating means of conventional design (not shown) will generally be associated with the upper portion of the sheath for causing movement of the writing member between a forwardly held writing position and a rearwardly held non-writing position.

Coil spring 12 is interactive between a pressing shoulder 22 inwardly directed from the lower portion of the sheath, and the rear portion 19 of the writing member. In such manner of disposition, the coil spring serves to drive the writing member to its retracted non-writing position and to hold it there. In alternative embodiments, particularly those with sheaths of shorter length, the coil spring may not be utilized. In such embodiments, a snap fit may be configured between portions of the writing member and the sheath to hold the writing member in its writing and non-writing positions. Equivalent holding means may, however, be utilized.

Sealing member 13 is of monolithic construction, having been fabricated of an elastomer by molding or other shaping methods. The sealing member is comprised of upper portion 23 having cylindrical bore 24 centered therein and centered upon the pen axis. The diameter of bore 24 is just slightly larger than the diameter of front portion 20 of the writing member. An annular retaining groove 25 is recessed within said bore adjacent the lowermost extremity thereof. Alternative embodiments of the sealing member may be of non-monolithic construction, fabricated of two or more specially interactive components.

Figure 1:
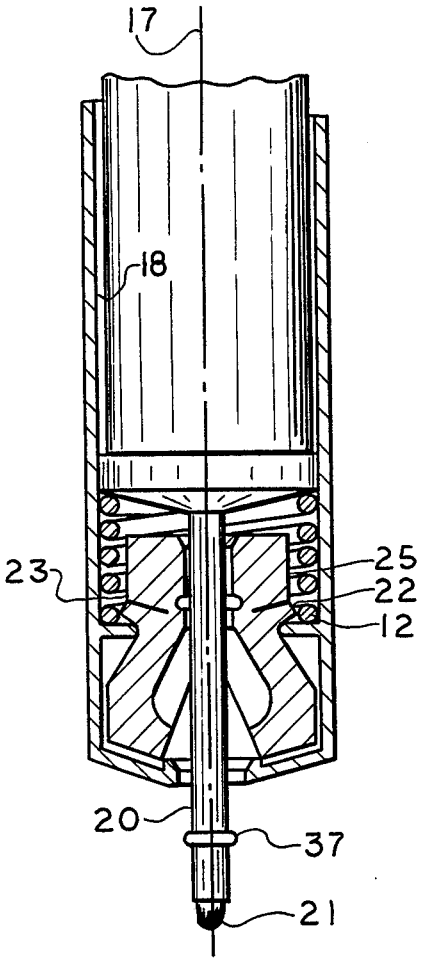
FIG. 1 is a sectional side view of an embodiment of marking pen of the present invention showing the writing member deployed in its writing position.
Figure 4:
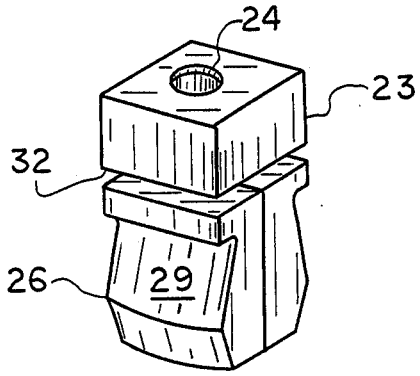
FIG. 4 is a perspective view of the sealing member of FIG. 2.
Figure 3:
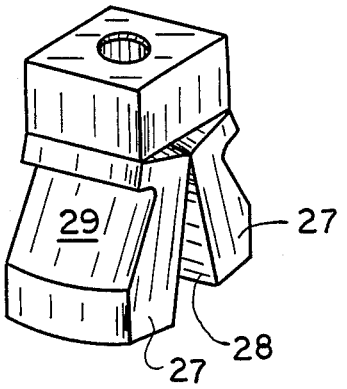
FIG. 3 is a perspective view of the sealing member of FIG. 1.

The lower portion 26 of the illustrated sealing member has two pendant segments 27 having contoured inner and outer surfaces 28 and 29, respectively. The segments are adapted to move between a divergent state shown in FIGS. 1 and 3, and a converged state shown in FIGS. 2 and 4. In the converged state, the segments are in their closest approach to the pen axis, and their inner surfaces mate to form a chamber 30 whose upper extremity communicates with said bore. In other embodiments, three or more such segments may be utilized. In still other embodiments the sealing member, by virtue of its elasticity, may be configured to allow the segments to move to their divergent state without lateral separation thereby reducing the size of the inner surfaces which must mate to form a chamber.

The intermediate portion 31 of the sealing member has recesses 32 which permit the segments to move in hinge-like manner with respect to upper portion 23. In alternative embodiments, movement of the segments may be accomplished without such recesses.

Pressing shoulder 22 is positioned and configured to engage outer surfaces of said segments. It is to be noted that the upper extremity of said outer surfaces has an outwardly directed abutment shoulder 33. The lower extremity has an outwardly tapered region 34. An inwardly depressed trough-like zone 35 is disposed between shoulder 33 and tapered region 34. By virtue of such configuration of the outer surfaces of the segments, and their interaction with pressing shoulder 22, the segments are directed to their divergent state when the sealing member is urged downwardly, and are directed to their coverged state upon upward movement of the sealing member. In alternative embodiments, two pressing shoulders may be positioned and configured to engage outer surfaces of the segments. In such embodiments, outer surfaces of the segments may be specially contoured to interact with said pressing shoulders such that one pressing shoulder directs the segments to their divergent state when the sealing member is urged downwardly and one pressing shoulder directs the segments to their converged state upon upward movement of the sealing member. In other embodiments, the segments may be directed to their divergent state by the agency of the elasticity of the material comprising the sealing member. In such embodiments, the abutment shoulder may be omitted.

A restraining hip 38 protruding outwardly from tapered region 34 is positioned and configured to engage pressing shoulder 22 to prevent excessive upward movement, and consequent dislodging, of the sealing member, particularly when the writing member, as in the form of a replaceable cartridge, is removed rearwardly from the sheath for exchanging. In alternative embodiments, other means of preventing excessive upward movement of the sealing member may be incorporated.

Holding means in the form of upraised lip 36 within the sheath and surrounding open front end 16 serves to hold the segments apart when the sealing member is in its downwardly urged position. Other equivalent embodiments of holding means may however, be utilized. In other embodiments, portions of the sealing member may be grooved, raised or otherwise specially modified to facilitate holding by lip 36 or by other holding means.

An annular activating shoulder 37 is affixed to the front portion of the writing member, and is adapted to fit within retaining groove 25 adjacent bore 24. When seated within the groove, the activating shoulder serves as a driving means for the sealing member, as a means of holding the sealing member in its upwardly urged position, and as a seal which causes the bore and chamber 30 to become an air-tight enclosure for writing tip 21. In alternative embodiments, activating shoulder 37 and interactive retaining groove 25 may have a shape other than annular. In other embodiments, retaining groove 25 may be omitted.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. In a marking pen comprising:

(a) a sheath having an upper portion and a lower portion terminating in an open front end, (b) a writing member disposed at least partially within said sheath and having a cylindrical front portion of relatively small diameter terminating in a writing tip, and a rear portion of relatively large diameter which serves as a confining reservoir for marking fluid, and (c) actuating means for causing movement of the writing member between a downwardly held writing position and an upwardly held non-writing position, the improvement comprising:

(d) an elastic sealing member positioned within the lower portion of said sheath and comprised of:

(1) an upper portion having a cylindrical bore centered upon the pen axis and having a diameter permitting penetrative insertion by the front portion of said writing member, (2) an annular retaining groove communicating with said cylindrical bore, (3) a lower portion having at least two segments having inner and outer surfaces and adapted to move between a divergent disposition and a converged disposition adjacent said axis wherein the inner surfaces mate to form a chamber whose upper extremity communicates with said bore, and (4) an intermediate portion having recesses which permit said segments to move in hinge-like manner with respect to said upper portion, (e) at least one pressing shoulder inwardly directed from the lower portion of said sheath and adapted to engage the outer surfaces of said segments whereby a pressing shoulder directs the segments to their divergent disposition and a pressing shoulder directs the segments to their converged disposition, (f) holding means associated with the lower portion of said sheath and adapted to hold said segments in their divergent disposition, and (g) an annular activating shoulder disposed upon the front portion of said writing member and adapted to fit tightly within said annular retaining groove, whereby, (h) when said writing member is moved downwardly within said sheath, said activating shoulder forces said sealing member downwardly, causing; (1) said pressing shoulder associated with divergence of the segments to act upon exterior surfaces of the segments to direct the segments to their divergent disposition, (2) said segments to become held in their divergent disposition by said holding means, (3) said activating shoulder to leave said bore, and (4) said writing tip to protrude from the open front end of the sheath, and (i) when said writing member is moved upwardly within said sheath, said activating shoulder reenters said bore, forcing said sealing member upwardly and causing; (1) said pressing shoulder associated with convergence of the segments to act upon exterior surfaces of the segments to direct the segments to their converged disposition, (2) placement of the writing tip within said chamber formed by the mated inner surfaces of the converged segments, and (3) sealing of the upper extremity of said chamber with the writing tip disposed therein.

2. The improvement of claim 1 wherein the upper extremity of the outer surface of said segments has an outwardly directed abutment shoulder, and the lower extremity of said outer surface has an outwardly tapered region.

3. The improvement of claim 2 wherein an inwardly directed trough-like zone is disposed between said abutment shoulder and tapered region.

* * * * *